US008227379B2

(12) United States Patent
Okada et al.

(10) Patent No.: US 8,227,379 B2
(45) **Date of Patent: *Jul. 24, 2012**

(54) THERMOSENSITIVE RECORDING MEDIUM AND RECORDING METHOD

(75) Inventors: Shinji Okada, Shizuoka (JP); Hiroshi Tohmatsu, Numazu (JP); Hideo Aihara, Fuji (JP); Hirokazu Watari, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 676 days.

This patent is subject to a terminal disclaimer.

(21) Appl. No.: 12/389,845

(22) Filed: Feb. 20, 2009

(65) Prior Publication Data

US 2009/0215622 A1 Aug. 27, 2009

(30) Foreign Application Priority Data

Feb. 25, 2008 (JP) ..... 2008-042657

(51) Int. Cl.
*B41M 5/30* (2006.01)

(52) U.S. Cl. ..... 503/201; 503/200; 503/226

(58) Field of Classification Search ..... None
See application file for complete search history.

(56) References Cited

U.S. PATENT DOCUMENTS

| | | | | |
|---|---|---|---|---|
| 4,904,636 | A * | 2/1990 | Hayashi et al. | 503/207 |
| 5,792,724 | A | 8/1998 | Suzaki et al. | |
| 5,866,504 | A | 2/1999 | Okada et al. | |
| 5,866,507 | A | 2/1999 | Suzaki et al. | |
| 5,935,899 | A | 8/1999 | Suzaki et al. | |
| 5,952,263 | A | 9/1999 | Suzaki et al. | |
| 5,985,791 | A | 11/1999 | Okada | |
| 6,140,268 | A | 10/2000 | Yamazaki et al. | |
| 6,319,878 | B1 | 11/2001 | Ina et al. | |
| 7,371,708 | B2 * | 5/2008 | Arai et al. | 503/201 |
| 2005/0176582 | A1 | 8/2005 | Arai et al. | |

FOREIGN PATENT DOCUMENTS

| | | |
|---|---|---|
| EP | 1552952 A1 | 7/2005 |
| JP | 63-315286 | 12/1988 |
| JP | 10-90830 | 4/1998 |
| JP | 2003-25731 | 1/2003 |
| JP | 2005-193564 | 7/2005 |
| JP | 3710832 | 8/2005 |
| JP | 2006-82309 | 3/2006 |
| JP | 2006-82483 | 3/2006 |
| JP | 2006-168319 | 6/2006 |
| JP | 2007-245543 | 9/2007 |

OTHER PUBLICATIONS

U.S. Appl. No. 06/874,950, filed Jun. 16, 1986 (abandoned).
European search report in connection with a counterpart European patent application No. 09 15 3613.

* cited by examiner

*Primary Examiner* — Bruce H Hess
(74) *Attorney, Agent, or Firm* — Cooper & Dunham LLP

(57) ABSTRACT

The present invention provides a thermosensitive recording medium including a white plastic support, a thermosensitive recording layer containing a binder resin as a binding agent, a colorless or pale color leuco dye and a color developer for heat-developing the leuco dye, a protective layer, and a back layer containing an electron-conductive needle filler and an ion-conductive polymer, wherein the thermosensitive recording layer is disposed on the white plastic support, the protective layer is disposed on the thermosensitive recording layer, and the back layer is disposed on a side of the white plastic support opposite to the side where the thermosensitive recording layer is disposed.

18 Claims, No Drawings

THERMOSENSITIVE RECORDING MEDIUM AND RECORDING METHOD

BACKGROUND OF THE INVENTION

1. Field of the Invention

The present invention relates to a thermosensitive recording medium which utilizes color-developing reaction between an electron-donating color-forming compound and an electron-accepting compound, and which is suitable for an image-forming sheet for medical use, especially for a diagnosis or reference of images by X-ray, MRI, CT, or the like.

2. Description of the Related Art

Conventionally, there have been widely known thermosensitive recording media having, on a support such as paper, a thermosensitive recording layer containing an electron-donating color-forming compound (hereinafter may be referred to as a "color former") and an electron-accepting compound (hereinafter may be referred to as a "color developer"). In the thermosensitive recording media, the color-former is reacted with the color-developer for color development. Such thermosensitive recording media are advantageous in that the recording machine therefor is compact and inexpensive, and its maintenance is easy, and therefore are broadly used for facsimiles, vending machines, printers for scientific measurement, printers for printing POS-bar code, or printers for CRT medical measuring instruments.

Also, a thermosensitive recording medium using a white plastic film on a support has been widely known, which is used in various applications such as POS bar code, display for a card-type mobile phone, medical image formation, or sheet-form display capable of writing and deleting with a reversible thermosensitive recording medium.

With regard to the medical image forming sheet, since it is used for diagnosis or reference, the object of recording is mainly structural information or shape information of the internal organs or bones of human. Accordingly, it is important that the images recognized precisely reflect original shape information, and thus it is expected that the sheet is excellent in pure blackness, high gradation, and high glossiness of the images, and also excellent in graduation, contrast and the like.

Thus, especially in medical applications of a thermosensitive recording material, high graduation is required compared to the conventional leuco type thermosensitive recording medium, so that a recording of higher output is demanded. When a plastic film is used as a support, there is a problem that the electrostatic attraction of trash and dust causes image defects such as white spots on a halftone portion.

In addition, in view of the contrast and the handling, it is preferred that the recording material itself is highly excellent in whiteness.

Furthermore, when the product has a shape of sheet, there are problems such that sheets are attached together at the time of feeding, causing double feeding issue in conveying the photoprints, and that the output sheets are prone to be closely attached to each other and thus they are difficult to handle.

In view of these required quality, it is required that the surface opposite to that of the support of the thermosensitive recording medium (back layer) be white or transparent, and have antistatic property and anti-adhesion property.

Although inventions that solve some of these problems have already been proposed, none of these inventions solves all of the above-mentioned problems and accordingly, additional improvements are needed.

Examples of the related patent documents include Japanese Patent (JP-B) No. 3710832, Japanese Patent Application Laid-Open (JP-A) Nos. 10-090830, 2005-193564, 2006-82483, and 2006-82309.

BRIEF SUMMARY OF THE INVENTION

The present invention relates to a thermosensitive recording medium which utilizes color-developing reaction between an electron-donating color-forming compound and an electron-accepting compound, and the object of the present invention is to provide a reflection type thermosensitive recording medium which is especially useful in medical applications, maintains excellent whiteness, has in excellent antistatic property under a low-humidity condition and excellent anti-attaching property.

The present inventors have carried out extensive studies, and have found that in order to concurrently fulfill the antistatic property at low-humidity and whiteness and anti-attaching property, which are generally incompatible with each other, in a thermosensitive recording medium consisting of white plastic support on which a binder resin as a binding material, thermosensitive recording medium containing, as main components, a colorless or pale color leuco dye and a developer for developing the leuco dye by heat, and a protective layer thereon are formed, and a back layer disposed on the support at the opposite side to the recording medium layer, it is extremely effective to incorporate at least an electron-conductive needle filler and an ion-conductive polymer into the back layer, and on the basis of this finding the present inventors have conducted further studies and completed the present invention.

The means for solving the problems is as follows:

<1> A thermosensitive recording medium including:

a white plastic support, a thermosensitive recording layer containing a binder resin as a binding agent, a colorless or pale color leuco dye and a color developer for heat-developing the leuco dye, a protective layer, and a back layer containing an electron-conductive needle filler and an ion-conductive polymer, wherein the thermosensitive recording layer is disposed on the white plastic support, the protective layer is disposed on the thermosensitive recording layer, and the back layer is disposed on a side of the white plastic support opposite to the side where the thermosensitive recording layer is disposed.

<2> The thermosensitive recording medium according to <1>, wherein the electron-conductive needle filler is needle particles of titanium oxide each surface of which is coated with antimony-doped tin oxide.

<3> The thermosensitive recording medium according to <1> or <2>, wherein the electron-conductive needle filler has a long axis of an average length of 3 μm to 10 μm and a short axis of an average length of 0.1 μm to 0.5 μm.

<4> The thermosensitive recording medium according to any one of <1> to <3>, wherein the back layer contains 10% by mass to 30% by mass of the electron-conductive needle filler and 10% by mass to 30% by mass of the ion-conductive polymer.

<5> The thermosensitive recording medium according to any one of <1> to <4>, wherein the back layer further contains a spherical filler.

<6> The thermosensitive recording medium according to <5>, wherein the spherical filler has an average particle size of 8 μm to 20 μm.

<7> The thermosensitive recording medium according to <6>, wherein the back layer further contains a spherical filler having an average particle size of 1 μm to 6 μm in addition to the spherical filler having an average particle size of 8 μm to 20 μm.

<8> The thermosensitive recording medium according to any one of <1> to <7>, wherein the back layer further contains an inorganic filler having an average particle size of 0.5 μm or less.

<9> The thermosensitive recording medium according to any one of <1> to <8>, wherein the back layer further contains an isobutylene polymer having a weight average molecular weight of 30,000 or more.

<10> The thermosensitive recording medium according to any one of <1> to <9>, wherein the back layer further contains a resin component obtained by crosslinking an isobutylene polymer having a weight average molecular weight of 30,000 or more by a crosslinking agent.

<11> The thermosensitive recording medium according to <10>, wherein the crosslinking agent is an aziridine compound.

<12> The thermosensitive recording medium according to <11>, wherein the aziridine compound has three or more functional groups.

<13> The thermosensitive recording medium according to any one of <1> to <12>, wherein the support is a white plastic film containing a polypropylene resin and a white filler, and a glossiness of a surface of the support where the thermosensitive recording medium is disposed is 50 [GS (75°)]% or more in accordance with JIS-P-8142.

<14> The thermosensitive recording medium according to any one of <1> to <13>, wherein each of the leuco dye and the color developer contained in the thermosensitive recording layer has a volume-average particle size of 0.3 μm to 1.0 μm.

<15> The thermosensitive recording medium according to any one of <1> to <14>, wherein the protective layer has a surface glossiness of 50 [GS (75°)]% or more.

<16> A recording method including heating and developing the thermosensitive recording medium according to any one of <1> to <15> using a printer equipped with a thermal head.

<17> A recording method including developing a gradation image on the thermosensitive recording medium according to any one of <1> to <15> in accordance with a pulse control method.

<18> A recording method including developing a gradation image on the thermosensitive recording medium according to any one of <1> to <15> in accordance with a voltage control method.

As is clear from the detailed and concrete description below, the present invention can provide a reflection type thermosensitive recording medium which is especially suitable for use in medical application, exhibits extremely excellent effects in maintaining pure white, keeps antistatic property under a lower humidity condition, and shows excellent anti-adhesion property when it is handled as sheets.

DETAILED DESCRIPTION OF THE INVENTION

In order to achieve the above-mentioned, required qualities, i.e., maintenance of pure white, antistatic property under a lower humidity condition, and anti-adhesion property, etc., it is necessary for the thermosensitive recording medium to perform antistatic function even in a lower humidity condition in the same way as in an ordinary humidity condition.

Generally, since an antistatic agent such as an ion-conductive polymer has less color, and is excellent in transparency, it can exhibit excellent whiteness if the support is white. However, a commonly-used ion-conductive polymer exhibits conductivity in the presence of moisture, so that it cannot maintain sufficient antistatic function under a low-humidity condition.

Meanwhile, since a well-known material, such as an electron-conductive filler, contains mobile electrons therein, it is not affected by humidity and can display excellent antistatic function even under a low-humidity condition.

However, well-known electron-conductive filler generally belongs to metal oxides, which has a color of blue, green or black, so that the layer itself is easily colored and its color is conspicuous is especially on a white support.

To overcome these problems, some measures such as making the filler minute or making the filler transparent may be taken, but the problem of coloration cannot be improved sufficiently.

In addition, in this case, since the layer becomes too flat, it is problematic that the sheets of the sheet-form thermosensitive recording medium tend to adhere to each other.

Putting all this together, the inventors have found that the above problems can be solved by efficiently combining an ion-conductive polymer, which has less color, and an electron-conductive filler, which has a slight color.

As the electron-conductive filler used in the present invention, an electron-conductive filler in the form of needle crystals is used in order for the filler to have anti-adhesion function and to be more efficient in conductivity. When compared to the commonly-used spherical or scale-like filler, the needle crystal fillers are present more closely to each other in the layer, and by the combination with ion-conductive polymer, its conductivity in the back layer can be enhanced efficiently even when the small amount of the needle fillers is used.

In addition, the needle crystal form can also perform anti-adhesion function.

In the present invention, the term needle in the needle crystal electron-conductive filler is defined as a rod whose long axis is 5 times to 100 times as long as short axis regardless of its shape of end and edge parts (e.g., square or round).

With regard to the antistatic agent, various antistatic agents are now used for various purposes. To achieve antistatic effect, it is necessary to have a surface resistance of $10^{10}$ Ωcm or less.

As the ion-conductive polymer used in the present invention, various polymers now well known to be an ion-conductive antistatic agent may be used. These ion-conductive polymers may be referred to as a surfactant-type antistatic agent. Such ion-conductive polymer denotes a polymer having a function of any of four kinds of surfactants, i.e., anionic, cationic, nonionic, and amphoteric surfactants, in the form of resin of common resinous polyethylene, polyvinyl acetate, polyacrylamide, maleic acid copolymer, polyacrylic acid and its ester, polymethacrylic acid and its esters, copolymer of vinyl chloride/vinyl acetate, copolymer of styrene, polyester, polyurethane, polyvinyl butyral, ethyl cellulose, polyvinyl acetal, polycarbonate, epoxy resin, polyamide, polyvinyl alcohol, starch gelatin, or the like. These ion-conductive polymers are relatively inexpensive, have abundant varieties, and good performance, however, they are susceptible to humidity, and antistatic property under a low-humidity is generally low, because many of them display conductivity by adsorption of water by the surfactant itself. As the antistatic agent, the ion-conductive polymer having cationic or amphoteric surfactant function is excellent in terms of antistatic property and durability.

Examples of the ion-conductive polymer having cationic surfactant function include ammonium polystyrene sulfonate (e.g., CHEMITAT SA101, product of Sanyo Chemical Industries, Ltd.), polystyrene having a substituent of fatty acid quaternary ammonium salt (e.g., RKM-6300, product of Sanyo Chemical Industries, Ltd.), α-ethyl(trimethylammonium)alkaloyl ester (e.g., SAT-5, and SAT-5 SUPER, products of Nihon Junyaku Co., Ltd.), and polyacrylic acid-modified resin (e.g., IN-177B, product of Takamatsu Oil & Fat Co., Ltd.).

The content of the ion-conductive polymer in the back layer is preferably 10% by mass to 30% by mass. The amount thereof less than 10% by mass tends to perform poor antistatic effect while the amount over 30% by mass tends to perform less water resistance property.

Examples of the electron-conductive needle filler used in the present invention include, but not limited to, $SnO_2$, $In_2O_3$, ZnO, $TiO_2$, MgO, $Al_2O_3$, BaO, $MoO_3$, and a complex oxide produced by mixing any of these oxides with P, Sb, Sn or Zn.

Of these, commonly used are those produced by doping tin oxide with antimony, which show high antistatic performance.

Many of these metal oxides are colored and impair transparency, and thus it is preferable that the amount thereof is as small as possible, so long as they satisfy the requirements of the present invention.

As a measure therefor, antistatic function is obtained even when a small amount thereof is used, by coating the surface of white metal oxide with a highly effective, conductive metal oxide of the similar kind. In the present invention, an excellent effect is achieved by using titanium oxide whose surface is coated with an antimony-doped tin oxide.

With regard to the size of the needle crystal, the average length of the long axis is 3 μm to 10 μm and that of the short axis is 0.1 μm to 0.5 μm to obtain efficient conductivity.

The amount of the needle electron-conductive filler in the back layer is preferably 10% by mass to 30% by mass. The amount less than 10% by mass is likely to perform poor antistatic effect, while the amount exceeding 30% by mass is likely to produce more coloration and lower whiteness.

The sizes of long axis and short axis of the electron-conductive filler are determined by taking a photograph of the fillers in the form of powder with a microscope (1,000 to 5,000 magnifications), measuring from the photograph the length of long axis and short axis of each particle (N=50 or greater), and calculating the average lengths of each of long axis and short axis.

Recently, electron-conductive polymers have been developed. Examples of organic polymers to be used therefor include conjugate polymers, including aliphatic polymers represented by polyacetylene, aromatic polymers such as polyparaphenylene, heterocyclic compounds such as polypyrrole, aromatic amines such as polyaniline; and polymers which has not a conjugated main chain but has cyclic π-conjugate group on the side chain. These polymer materials are doped with an electron donor. These materials perform conductive function in a low-humidity condition because the conductivity of these materials does not occur due to moisture as in conductive metal oxides. These materials, however, have slight color, and thus may be added together with the above mentioned two kinds of polymers in an amount so small that coloration does not occur.

To achieve the anti-adhesion effect in the present invention, it is effective to incorporate spherical fillers into the back layer. Examples of the spherical fillers include spherical inorganic fillers such as glass beads and silica, and spherical organic fillers of a is condensation polymer such as polystyrene resin, polyethylene resin, polypropylene resin, ureaformalin resin, silicone resin, polymethylmethacrylate resin (PMMA), melamine-formaldehyde resin, polyester, and polycarbonate. The spherical fillers for use in the present invention are, however, not limited to these examples.

In the present invention, the spherical filler is that which can be seen as round from every angle, and has a spherical body in which all the distances from a center portion to its outer surface (radii) are such that a value calculating by subtracting the minimum radius from the maximum radius lies within 20% of the maximum radius.

Preferably, these fillers have an average particle size in the range of 8 μm to 20 μm because they can prevent adhesion and because convex portions can be efficiently formed on the surface in the case of spherical filler.

Furthermore, when a spherical filler of medium particle size having an average particle size of 1 μm to 6 μm is used in combination with a spherical filler of large particle size having an average particle size of 8 μm to 20 μm, the filler of large particle size serves as a spacer which prevents adhesion of double sheets, and the filler of medium particle size reinforces the gap caused by the spacers, enhancing the adhesion preventing function. More preferably, the filler of large particle size is preferred to have an average particle size of 10 μm to 20 μm.

In addition to these spherical particles, an inorganic filler having an average particle size of 0.5 μm or less may be used in combination so as to obtain good touch feeling and feeling of paper quality. At the same time, the effect for sealing property and printing property is also improved. Preferably, the inorganic filler has an average particle size of 0.5 μm or less and is white. Examples of the inorganic filler include inorganic micro powder such as calcium carbonate, silica, aluminum hydroxide, zinc hydroxide, barium sulfate, clay, talc, and surface-treated calcium or silica. However, the inorganic filler is not limited to these examples, and may include common inorganic pigments. The shape of the inorganic filler may be an indeterminate form, a scale-like form or a sphere.

With regard to the measurement of the average particle size of the filler and the measurement of the volume-average particle size, the volume-average particle sizes were measured using the laser diffraction particle size analyzer LA 920 (product of Horiba Seisakusho).

Amount of each filler in the back layer is preferably as follows: an amount of the spherical filler having an average particle size of 8 μm to 20 μm is preferably 0.1% by mass to 5% by mass, an amount of the spherical filler having an average particle size of 1 μm to 6 μm is preferably 0.5% by mass to 10% by mass, and an amount of the inorganic filler having an average particle size of 0.5 μm or less is preferably 1% by mass to 20% by mass.

As the resin to be used in the back layer, various known resins may be used. Examples include polyethylene, polyvinyl acetate, polyacrylamide, maleic acid copolymer, polyacrylic acid and its ester, polymethacrylic acid and its esters, vinyl chloride/vinyl acetate copolymer, styrene copolymer, polyester, polyurethane, polyvinyl butyral, ethylcellulose, polyvinyl acetal, polycarbonate, epoxy resin, polyamide, polyvinylalcohol, starch, and gelatin These resins may be used solely or in any combination of two or more. The resin may be selected in view of affinity to the support or the antistatic agent to be used.

As a binder of the back layer, preferred is a binder having a high molecular weight and is highly adhesive in order to prevent curling to the surface of the recording layer. In the present invention, it is especially preferred to use an isobutylene polymer having a weight average molecular weight of 30,000 or higher, and it is extremely effective in the case where the back layer is easily curled to the thermosensitive recording side.

The weight average molecular weight of the isobutylene polymer may be determined through gel filtration chromatography (GFC).

The amount of the binder resin in the back layer is preferably 20% by mass to 70% by mass.

In addition to the resin, a crosslinking agent for crosslinking the resin may be incorporated so as to form the back layer excellent in water resistance property and adhesiveness in handling.

There is no limitation to the crosslinking agent so long as it can cross-link the resin to be used, but when the above-mentioned isobutylene polymer is used, it was found to be effective to use aziridine crosslinking agent.

The aziridine crosslinking agent may preferably be a compound having, as a functional group, an ethylene imine group with the following formula. The compounds having two or more functional groups are preferred, with these having three or more functional groups being more preferred, because degree of cross-linkage becomes high. The aziridine crosslinking agent having three or more functional groups was found to be excellent in water resistance property and adherence to the support.

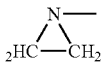

Preferred examples thereof include CHEMITITE PZ-33 and CHEMITITE DZ-22E (these products are of Nippon Shokubai Co., Ltd.), having the following structural formulas.

PZ-33

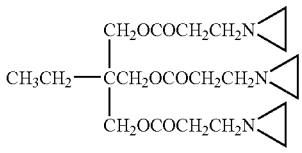

2,2-Bishydroxyemethylbutanol-tris[3-(1-aziridinyl) propionate

DZ-22E

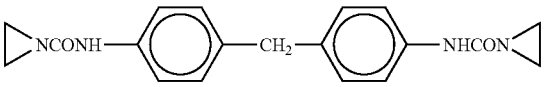

4,4-Bis(ethyleneiminocarbonylamino)diphenylmethane

The amount of the crosslinking agent contained in the back layer is preferably 2% by mass to 20% by mass.

The thickness of the back layer is preferably 0.5 g/m$^2$ to 15 g/m$^2$ on the basis of the deposition amount. When the amount thereof is smaller than 0.5 g/m$^2$, the filler is difficult to be maintained therein and might fall off from the back layer, and also, the antistatic function does not sufficiently work. When the amount exceeds 15 g/m$^2$, the filler added is embedded so that anti-adhesion effect is vanished.

As the white plastic support used in the present invention, a support as used in the conventional leuco-type thermosensitive recording medium may be used, examples of which include a white polyester film, a white polypropylene, a plastic resin-laminated paper, and a synthetic paper.

As for the surface glossiness at the thermosensitive recording layer side of the support, when the surface glossiness (GS (75°)) measured in accordance with JIS-P-8142 is 50% or more, the surface glossiness of the thermosensitive recording medium improves and is adhesiveness to a thermal head is excellent, and thus precision of images is improved and omission of images is prevented, and also the recording medium is highly sensitive.

Although there have generally been a measure to improve surface glossiness and sensibility by smoothing the thermosensitive recording medium using a super calendar and the like, the use of such support whose surface glossiness (GS (75°)) measured in accordance with JIS-P-8142 is 50% or more enables to omit the processes and simplify the process as a whole.

In order to improve adhesiveness of the applied layer of the thermosensitive recording layer, at least one side of the support may be subjected to corona discharge, oxidization (with chromic acid, etc.), or etching for surface modification.

As the support for use in medical field, a synthetic paper composed mainly of polypropylene of 50 μm to 250 μm may be used in terms of handling performance.

The synthetic paper composed mainly of propylene may preferably be a white plastic film containing polypropylene resin and white filler. Examples of the white filler include silica, zinc oxide, calcium carbonate, barium sulfate, titanium oxide, lithopone, talc, pagodite, kaolin, aluminum hydroxide, and calcined kaolin. The white filler, however, is not limited to these examples, and an inorganic pigment commonly used may also be used. The amount of the white filler may preferably be 0.1% by mass to 50% by mass.

(Color Developer)

As a color developer used in the present invention, a variety of electron-accepting substances which react with the leuco dyes when heated and which make them develop color can be applied; specific examples thereof include the following phenolic substances, organic or inorganic acid substances, and esters or salts thereof.

Gallic acid, salicylic acid, 3-isopropylsalicylic acid, 3-cyclohexylsalicylic acid, 3,5-di-tert-butylsalicylic acid, 3,5-di-α-methylbenzylsalicylic acid, 4,4'-isopropylidenediphenol, 1,1'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, 3,5-xylenol, thymol, methyl-4-hydroxybenzoate, 4-hydroxyacetophenone, novolac-type phenolic resins, 2,2'-thiobis(4,6-dichlorophenol), catechol, resorcin, hydroquinone, pyrogallol, phloroglycine, phloroglycinecarboxylic acid, 4-tert-octylcatechol, 2,2'-methylenebis(4-chlorophenol), 2,2'-methylenebis(4-methyl-6-tert-butylphenol), 2,2-dihydroxydiphenyl, ethyl p-hydroxybenzoate, propyl p-hydroxybenzoate, butyl p-hydroxybenzoate, benzyl p-hydroxybenzoate, p-hydroxybenzoic acid-p-chlorobenzyl, p-hydroxybenzoic acid-o-chlorobenzyl, p-hydroxybenzoic acid-p-methylbenzyl, p-hydroxybenzoic acid-n-octyl, benzoic acid, zinc salicylate, 1-hydroxy-2-naphthoic acid, 2-hydroxy-6-naphthoic acid, 2-hydroxy-6-naphthoic acid zinc, 4-hydroxydiphenylsulfone, 4-hydroxy-4'-chlorodiphenylsulfone, bis(4-hydroxyphenyl)sulfide, 2-hydroxy-p-toluic acid, 3,5-di-tert-butylsalicylic acid zinc, 3,5-di-tert-butylsalicylic acid tin, tartaric acid, oxalic acid, maleic acid, citric acid, succinic acid, stearic acid, 4-hydroxyphthalic acid, boric acid, thiourea derivatives, 4-hydroxythiophenol derivatives, bis(4-hydroxyphenyl)acetic acid, bis(4-hydroxyphenyl)ethyl acetate, bis(4-hydroxyphenyl)n-propyl acetate, bis(4-hydroxyphenyl)m-butyl acetate, bis(4-hydroxyphenyl)phenyl acetate, bis(4-hydroxyphenyl)benzyl acetate, bis(4-hydroxyphenyl)phenethyl acetate, bis(3-methyl-4-hydroxyphenyl)acetic acid, bis(3-methyl-4-hydroxyphenyl)methyl acetate, bis(3-methyl-4-hydroxyphenyl)n-propyl acetate, 1,7-bis(4-hydroxyphenylthio)3,5-dioxaheptane, 1,5-bis(4-hydroxyphenylthio)3-oxaheptane, 4-hydroxyphthalic acid dimethyl ester, 4-hydroxy-4'-methoxydiphenylsulfone, 4-hydroxy-4'-ethoxydiphenylsulfone, 4-hydroxy-4'-isopropoxydiphenylsulfone, 4-hydroxy-4'-propoxydiphenylsulfone, 4-hydroxy-4'-butoxydiphenylsulfone, 4-hydroxy-4'-isobutoxydiphenylsulfone, 4-hydroxy-4-butoxydiphenylsulfone, 4-hydroxy-4'-tert-butoxydiphenylsulfone, 4-hydroxy-4'-benzyloxydiphenylsulfone, 4-hydroxy-4'-phenoxydiphenylsulfone, 4-hydroxy-4'-(m-methylbenzyloxy)diphenylsulfone, 4-hydroxy-4'-(p-methylbenzyloxy)diphenylsulfone, 4-hydroxy-4'-(o-methylbenzyloxy)diphenylsulfone and 4-hydroxy-4'-(p-chlorobenzyloxy)diphenylsulfone.

In the present invention, the amount of the color developer contained in the thermosensitive recording layer is preferably in a range of 0.5% by mass to 5.0% by mass, more preferably 2.0% by mass to 4.0% by mass with respect to the total mass of the leuco dye. When the amount of the color developer falls within this range, the image storage property of halftone portions can greatly enhanced. In this case, since the efficiency of color developing is increased, the maximum color density can be obtained even in a thin film. The advantageous effect of using thin film in gradation media lies in control of thickness of film during application process and the lowering of remaining moisture and remaining solvent, and further in cost reduction due to reduction of coating amount.

The leuco dye used in the present invention is selected from electron-donating compounds, and each of these compounds may be used alone or in combination with two or more. The leuco dye is a dye precursor which is colorless or pale per se, and the leuco dye is not particularly limited and may be suitably selected from leuco dyes known in the art. Examples thereof include triphenylmethane phthalide, triallylmethane, fluoran, phenothiazine, thiofluoran, xanthene, indophthalyl, spiropyran, azaphthalide, chromenopyrazole, methines, rhodamineanilinolactam, rhodaminelactam, quinazoline, diazaxanthene, and bislactone. Particular preference is given to fluoran-based leuco dyes and phthalide-based leuco dyes, and examples thereof include the following compounds; however, it should be noted that the leuco dye of the present invention is not limited thereto.

2-anilino-3-methyl-6-diethylaminofluoran, 2-anilino-3-methyl-6-(di-n-butylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-sec-butyl-N-ethylamino)fluoran, 2-anilino-3-methyl-6-(N-n-amyl-N-ethylamino)fluoran, 2-anilino-3-methyl-6-(N-iso-amyl-N-ethylamino)fluoran, 2-anilino-3-methyl-6-(N-n-propyl-N-isopropylamino)fluoran, 2-anilino-3-methyl-6-(N-cyclohexyl-N-methylamino)fluoran, 2-anilino-3-methyl-6-(N-ethyl-N-p-toluidino)fluoran, 2-anilino-3-methyl-6-(N-methyl-N-p-toluidino)fluoran, 3-diethylamino-7,8-benzofluoran, 1,3-dimethyl-6-diethylaminofluoran, 1,3-dimethyl-6-di-n-butylaminofluoran, 3-diethylamino-7-methylfluoran, 3-diethylamino-7-chlorofluoran, 3-diethylamino-6-methyl-7-chlorofluoran, 10-diethylamino-2-ethylbenzo[1,4]thiadino[3,2-b]fluoran, 3,3-bis(1-n-butyl-2-methylindole-3-yl)phthalide, 3,3-bis(4-diethylamino-2-ethoxyphenyl)-4-azaphthalide, 3-[2,2-bis(1-ethyl-2-methyl-3-indolyl)vinyl]-3-(4-diethylaminophenyl)phthalide, and 3-[1,1-bis(4-diethylaminophenyl)ethylene-2-yl]-6-dimethylaminophthalide.

As for the thermosensitive recording medium especially for medical use, it is preferable to use three or more leuco dyes in combination to obtain, in particular, a single tone.

Accordingly, in addition to the leuco dye represented by formula (1) shown below, one or more red-coloring dyes and/or one or more orange-coloring dyes along with one or more near infrared-coloring dyes may be used in combination. It is preferable to mix at least three leuco dyes in total, and if needed, four to six leuco dyes. The terms red-coloring dye, orange-coloring dye, and near infrared-coloring correspond to each range of absorbed wavelength of the color tone of each dye when developed with heat. The reason why red-coloring dye and/or orange-coloring dye, and near infrared-coloring dye should be added is as follows: Although a colored material obtained using leuco dye represented by General Formula (1) has two absorption bands in the visible range, there are valley portions at around 450 nm to 600 nm and around 650 nm to 700 nm. The above red-coloring dye and/or orange-coloring dye, and near infrared-color developing dye are added to fill the valley portions to thereby make the absorption in visible range flat as in the case of a silver salt.

General Formula (1)

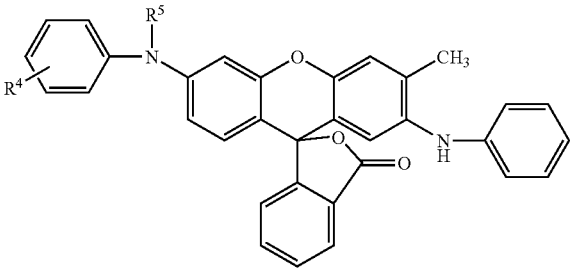

In General Formula (1), $R^4$ is a hydrogen atom, a halogen atom, an alkyl group having 1 to 4 carbon atoms, or an alkoxy group having 1 to 4 carbon atoms, and $R^5$ is an alkyl group having 1 to 4 carbon atoms.

As a rough standard, the degree of blackness of the image can be represented by the ratio of the minimum value to the maximum value of the absorbance in the region of around 430 nm to 650 nm of the absorption spectrum. When this ratio is 0.65 or more, at least the condition of practical blackness can be satisfied on a film viewer. The ratio of 0.75 or more is preferred because any influence from a color of fluorescent light such as daylight color and day-white color can be reduced. As to the mixing ratio of these dyes, it is preferred to use a large amount of a black-color developing leuco dye, which shows high absorption, in terms of high concentration, tone adjustment, and storage stability. Specifically, it is preferable that the leuco dye represented by General Formula (1) is contained in the range of 40% by mass to 80% by mass based on the total content of the leuco dyes, while a red-coloring dye and/or an orange-coloring dye and near infrared-coloring dye are each contained in the range of 10% by mass to 30% by mass.

When the amount of the leuco dye represented by General Formula (1) is over the above-described range, it is difficult to obtain blackness of the image portion. When the amount of the leuco dye of General Formula (1) is less than 40% by mass, it is difficult to secure the maximum color density of the image portion.

Examples of the red or orange dye used in the mixture with the leuco dye of General Formula (1) include rhodamine-B orthochloroanilinolactam, 3,6-bis(diethylamino)fluoran-γ-(4'-nitro)anilinolactam, 1,3-dimethyl-6-diethylaminofluoran, 1,3-dimethyl-6-dibutylaminofluoran, 2-chloro-3-methyl-6-diethylaminofluoran, 2-chloro-6-diethylaminofluoran, 3-chloro-6-N-cyclohexylaminofluoran, 6-diethylaminobenzo[60 ]fluoran, 6-(N-ethyl-N-isopentylamino)benzo[α]fluoran, 3,3-bis(1-n-butyl-2-methylindol-3-yl)phthalide, 3,3-bis(i-n-octyl-2-methylindol-3-yl)phthalide, spiro[chromeno[2,3 C]pyrazol-4 (H)-1'-phthalan]-7-(N-ethyl-N-isoamylamino)-3-methyl-1-p henyl-3'-one.

In the production of the thermosensitive recording medium of the present invention, in order to have the leuco dye and color developer bind to the support, a variety of commonly-used binding agents may be used appropriately. Examples of a binder resin as such the binding agent include polyvinylalcohol, starch and the derivatives, cellulose derivatives such as hydroxymethylcellulose, hydroxyethylcellulose, carboxymethylcellulose, methylcellulose, and ethylcellulose, water-soluble polymers such as sodium polyacrylate, polyvinylpyrrolidone, acrylamide/acrylate copolymer, acrylamide/acrylate/methacrylic acid ternary copolymer, alkali salt of styrene/maleic acid anhydride copolymer, alkali salt of isobutylene/maleic acid anhydride copolymer, polyacrylamide, sodium alginate, gelatin, and casein, emulsions of polyvinyl acetate, polyurethane, polyacrylic acid, polyacrylate, vinyl chloride/vinyl acetate copolymer, polybutylmethacrylate, and ethylene/vinyl acetate copolymer, latexes such as styrenelbutadiene copolymer, and styrene/butadiene/acryl copolymer.

In addition to these binders, surfactants, crosslinking agents, and adjuvants can be used in combination. A combined use of the binder and a crosslinking agent results in excellent adhesiveness to the support and enhances water resistance and solvent resistance.

As a crosslinking agent, a variety of commonly-used ones may be used.

In the thermosensitive recording layer in the present invention, any supplemental additives commonly used in the conventional thermosensitive recording material, such as filler, heat-melting substance, and surfactant, may be used if necessary, in addition to the leuco dyes and color developers. Examples of the filler include powder of an inorganic material such as calcium carbonate, silica, zinc oxide, titanium oxide, aluminum hydroxide, zinc hydroxide, barium sulfate, clay, talc, surface-treated calcium, and surface-treated silica, and powder of an organic material such as ureaformalin resin, styrene/methacrylic acid copolymer, and polystyrene resin. Examples of the heat-melting substance include a substance having a melting point of approximately 50° C. to 200° C. such as higher fatty acids and their esters, amides or metallic salts, various waxes, condensates of an aromatic carboxylic acid and an amine, phenyl benzoate, a higher straight-chain glycol, 3,4-epoxy-hexahydrophthalic acid dialkyl, higher ketone, p-benzylbiphenyl, and other heat-melting organic compounds.

The method of applying the thermosensitive recording layer is not particularly limited and may be selected from conventionally known methods. The thickness of the thermosensitive recording layer is preferably 1 μm to 30 μm, more preferably 3 μm to 20 μm. When the thickness is too thin, sufficient image density cannot be obtained, and when the thickness is too thick, thermosensitivity of the recording material is reduced, the fogging occurs, and the cost is increased.

As for the resin used in the protective layer in the present invention, it is necessary for the resin to have good film-forming performance, high thermal resistance, mold-releasing performance at a high temperature, and smoothness, as well as such functions as insolubility to water or alcohol, and barrier function, so as to avoid the sticking caused by the heat from the thermal head, while maintaining high glossiness; to prevent dreg adhesion to the thermal head caused by continuous printing under high energy; or to keep water resistance and alcohol resistance property in handling the printed images. Taking these points into account, it is extremely effective to use, in the uppermost layer, a core/shell type emulsion, which contains at least a shell part consisting at least of acrylamide resin and a core part consisting of acryl resin, and an aziridine compound.

Briefly, the use of such material as having a core/shell structure in which the core and the shell are different in their qualities of the materials and performances, enables to simultaneously fulfill the requirements of high film-forming performance, high thermal resistance, flexibility, water resistance and solvent resistance, which are generally incompatible with each other.

A softening point of the core/shell emulsion may be about 160° C. to 260° C. In the case where the softening point is higher than 260° C., the film itself becomes so stiff that cracks often occur in the film and curling of the film also often occurs, when the film is bended in handling or on the conveying path of a printer. These problems are likely to occur especially in a low-humidity condition.

In the case where the softening point is lower than 160° C., the surface becomes rough or head-dross occurs in the thermal recording by using a thermal head, which tend to cause the tailing phenomena on the image.

A crosslinking agent used in the present invention may preferably be an aziridine compound. Since an aziridine compound very quickly works in a cross-linking reaction, it exhibits its function even immediately after drying the film formed, which enables to shorten and simplify the processes by, for example, eliminating the need for a curing process for crosslinking reaction.

The number of functional groups of the aziridine compound is preferably 2 or more, more preferably 3 or more. The increase in the number of the functional groups can enhance the density of crosslinkage, which enhances the barrier function to thereby enhance a water resistance performance and a solvent resistance performance.

The amount of the crosslinking agent is preferably 0.01 parts by mass to 1 part by mass, more preferably 0.05 parts by mass to 0.5 parts by mass, per 1 part by mass of the resin. When the amount of the crosslinking agent is lower than 0.01 parts by mass, the crosslinking reaction does not sufficiently occur, and so the resin film is burned down by the heat of the thermal head, or a part of the resin sticks to a heating element of the thermal head at the time of thermal recording.

When the amount of the crosslinking agent is greater than 1 part by mass, since the amount thereof become excessive, amounts of a substance that remained non-crosslinked and of a substance auto-crosslinked by moisture are increased, which can cause a head-dross at the time of thermal recording which results in the tailing phenomenon on the image.

The protective layer in the present invention may contain a lubricant in view of head matching. As the lubricant, any conventionally known lubricants may be used.

Examples thereof include a variety of waxes, including animal, vegetable, mineral, and petroleum waxes, such as higher fatty acids and their metal salts, higher fatty acid amides, higher fatty acid esters, montanic acid wax, polyethylene wax, paraffin wax, carnauba wax, and rice wax. These waxes may be used solely or in is combination of two or more.

Of these, a metal salt of a higher fatty acid is highly effective in the lubricant function and mold-releasing effect, as well as high anti-sticking property and high anti-dross-adherence property. More preferably, it has been recognized that zinc stearate is highly effective and can provide excellent quality.

In the recording of medical images, where gradation performance is particularly relevant, it is required to respond to various levels of thermal energies from the thermal head in accordance with the images to be recorded. This requirement can be met with a combination of two or more kinds of lubricant particles having different melting points. Specifically, with regard to all the images of from low printing ratio to high printing ratio, the incorporation of lubricants can prevent the head-dross adherence, anti-sticking effect, high glossiness of the image, and pure blackness of the image.

As a pigment to be used in the protective layer, various inorganic pigments widely known may be used. Examples thereof include inorganic pigments such as zinc oxide, calcium carbonate, barium sulfate, titanium oxide, lithopone, talc, wax, kaolin, aluminum hydroxide, and calcined kaolin, and in addition to these, an organic pigment such as ureaformalin resin, polyethylene powder or the like may be used in combination.

As for the pigments used in the present invention, an average particle size thereof is needed to be 0.005 μm to 0.5 μm. In view of the surface glossiness, it is preferred for the pigment to have an amount of oil absorption of 100 cc/100 g or low and specific surface area of 100 $m^2/g$ or more. It is preferred to use aluminum hydroxide, kaolin, or calcium carbonate because these can readily be micronized and provide excellent glossiness of the surface.

In the present invention, organic pigments may be used besides the inorganic pigments. As an organic pigment, a variety of organic pigments commonly known may be used, including a condensation polymer such as polystyrene resin, polyethylene resin, ureaformalin resin, silicone resin, polymethacrylmethylacrylate resin, melamine-formaldehyde resin, polyester, and polycarbonate. Since these organic pigments do not impair the glossiness, attaining of which is one of the purposes of the present invention, they can be incorporate as a particle of 1.5 times or less in volume ratio with regard to the resin for the protective layer (dry volume of the above-mentioned core/shell type emulsion plus other binder resin to be incorporated at need).

The protective layer can be applied in accordance with any conventionally known method without any limitation. The thickness of the protective layer as the uppermost layer of the thermosensitive recording medium is preferably 0.1 μm to 20 μm, more preferably 0.5 μm to 10 μm. When the protective layer is too thin, it fails to improve the function as the protective layer such as storage property and head-matching property of the thermosensitive recording medium; when the protective layer is too thick, the thermal sensitivity of the thermosensitive recording medium lowers and the protective layer is also disadvantageous in terms of cost.

The glossiness of the surface of the protective layer may preferably be within the range of 50 [GS (75°)]% or higher when used as a image-forming sheet for medical use. If the protective layer be formed only of resins to achieve high glossiness, it is known to result in the sticking caused by adherence and burning at the time of thermal recording with a thermal head, and to cause a conveying failure.

These problems can be solved with conventionally-used methods, for example, by forming the protective layer with a resin having high thermal resistance and high smoothness properties or with such a resin and a crosslinking agent; by incorporating fine filler or a lubricant suitable for head-matching; or by forming an intermediate layer under the protective layer, the intermediate layer containing a substance effective for the matching such as filler and lubricant, and the protective layer being composed mainly of resins.

Also, in the present invention, in order to obtain high glossiness, it is preferred to have high glossiness not only in the protective layer but also in the adjacent lower layer. Specifically, the adjacent lower layer preferably has surface glossiness of 30 [GS (75°)]% or more according to JIS-P-8142.

When the adjacent lower layer is the thermosensitive recording layer, high glossiness can be achieved by adjusting a volume average particle size of the particles contained in the thermosensitive recording layer to be 0.3 μm to 1.0 μm. Namely, each of the colorless or pale-color leuco dye, color-developer for heat-developing the leuco dye, and additives, such as a pigment, has a volume average particle size of 0.3 μm to 1.0 μm. High glossiness is attainable also by smoothing the surface by setting the content of the resin binder in the thermosensitive recording layer to 30% by mass to 80% by mass of the thermosensitive recording layer.

It is also effective to lay an intermediate layer composed mainly of resin between the thermosensitive recording layer and the uppermost layer. Increasing the ratio of the resin in the intermediate layer can provide extremely high glossiness.

In forming the intermediate layer, it is preferable that the layer be composed mainly of a water-soluble resin and/or water-dispersive resin to attain high glossiness. In addition, using a crosslinking agent in combination is also preferred in order to provide a barrier function to water and solvents.

To be more effective, the intermediate layer preferably contains a core/shell emulsion and aziridine compound as a crosslinking agent, the core/shell emulsion being composed of shell portion made of acrylamide resin, and core portion made of acrylic resin, which are used in the uppermost layer.

The method of applying the intermediate layer is not particularly limited and may be selected from the conventionally known methods. The thickness thereof may preferably be 0.1 μm to 20 μm, more preferably 0.5 μm to 10 μm. When the intermediate layer is too thin, the properties of glossiness, water resistance, and solvent resistance do not sufficiently function, and when the intermediate layer is too thick, the thermal sensitivity of the recording medium lowers and also the protective layer is disadvantageous in terms of cost.

The thermosensitive recording medium of the present invention has normally a long shape immediately after produced, but as a commodity, it is tightly rolled-up, or is cut out into sheets having a predetermined size and put into a bag as a set of predetermined number of sheets. In view of the nature of the product, irrespective of its shape as a commodity, it is normally preferred that the products are stored or put on the market as a product packaged with a shading packaging material. At the time of use, after the package is removed, the thermosensitive recording medium is taken out and loaded into any image forming machine.

In forming an image using the thermosensitive recording medium of the present invention, any literal and/or shape information is reflected on the thermosensitive recording medium and the medium is then heated by a heating means. Although the heating means is not particularly limited and may be selected from a thermal pen, thermal head, laser heater, etc., it is most preferable to use a thermal head in view that the thermosensitive recording medium of the present invention is intended especially for printing images of high definition and high gradation such as medical images, and in view of cost for the machine, output speed, and compactness of the machine.

Additionally, for the medical use, it is necessary that the image has gradation property. A means to form gradation images may be either a pulse-control method or a voltage-control method.

EXAMPLES

The present invention will next be described in more detail by way of examples, which should not be construed as limiting the present invention thereto. Note that the term "part" and the symbol "%" used below are both on a mass basis.

Comparative Example 1

| (1) Preparation of thermosensitive recording layer coating solution | |
|---|---|
| [Solution A] Preparation of dye dispersion solution | |
| 2-Anilino-3-methyl-6-dibutylaminofluoran: | 20 parts |
| 10% Aqueous solution of polyvinyl alcohol: | 20 parts |
| Water: | 60 parts |
| [Solution B] Color developer dispersion solution | |
| 4-Hydroxy-4'-isopropoxydiphenylsulfone: | 12 parts |
| Silica: | 4 parts |
| Stearic acid amide: | 4 parts |
| 10% Aqueous solution of polyvinyl alcohol: | 20 parts |
| Water: | 60 parts |
| [Solution C] Recording layer solution | |
| Solution A: | 12.5 parts |
| Solution B: | 62.5 parts |
| 10% Aqueous solution of polyvinyl alcohol: | 25 parts |

The above-listed components were pulverized with a magnetic ball mill so that the volume-average particle size of the formed particles was adjusted to 0.9 μm, whereby [solution A] and [solution B] were prepared. Next, 12.5 parts of [solution A], 62.5 parts of [solution B], and 25 parts of a modified polyvinyl alcohol (KURARAY-K-POLYMER KL-318, solid 10%) were mixed under stirring, whereby a thermosensitive recording layer solution [solution C] was prepared.

The [solution C] was applied onto a synthetic paper having a thickness of 170 μm (white plastic film containing polypropylene resin and white filler, product of Nanya, PX170, surface gloss of 60% or more) using a wire bar, and the coating was dried for 3 minutes with a dryer kept to 70° C., whereby the thermosensitive recording layer A having the deposition amount of 8.5 g/m$^2$ was formed.

| (2) Preparation of protective layer coating solution | |
|---|---|
| [Solution A] Filler dispersion solution | |
| Calcium carbonate (BRT15): | 20 parts |
| 10% Aqueous solution of polyvinyl alcohol: | 20 parts |
| Water: | 60 parts |
| [Solution B] Protective layer solution | |
| Core/shell resin (core portion: acryl resin, shell portion: acrylamide resin) (product of Mitsui Chemical, BARRIERSTAR B1000, 20% solution): | 40 parts |
| Zinc stearate emulsion (product of Chukyo Yushi Co., Ltd., K-994M, volume-average particle size: 0.2 μm): | 10 parts |
| Solution A (calcium carbonate dispersion solution, volume-average particle size: 0.2 μm): | 12 parts |
| Water: | 45 parts |
| Aziridine compound (CHEMITITE PZ-33, product of Nippon Shokubai Co., Ltd.): | 2 parts |

Each composition having each of the above-described formulation was pulverized by a magnetic ball mill and [protective layer solution B] having a volume-average particle size of 0.2 μm was prepared, and mixed under stirring, whereby the uppermost layer solution F was prepared. Next, this solution was applied onto the recording layer A by using a wire bar, and dried for 3 minutes with a dryer maintained at 70° C. to form a protective layer of 3 g/m$^2$ thick, whereby sample A having the protective layer was prepared. The surface glossiness of the protective layer was 62 [GS (75°)]%.

| (3) Preparation of back layer coating solution A | |
|---|---|
| Water: | 27 parts |
| 10% Aqueous solution of polyvinyl alcohol: | 70 parts |
| Conductive needle filler (needle Sb-doped $SnO_2$) (product of Ishihara Sangyo Kaisha Ltd.; FS-10P) (average of short axis: 0.13 μm average of long axis: 1.68 μm): | 3 parts |

The back layer coating solution A was applied onto the backside of the sample A having the protective layer, and the sample was dried to form 4 g/m$^2$ of the back layer, whereby a sample of Comparative Example 1 was prepared.

Comparative Example 2

A sample of Comparative Example 2 was prepared in the same manner as in Comparative Example 1 except that the back layer was formed using the back layer coating solution B as shown below.

| Preparation of back layer coating solution B | |
|---|---|
| Water: | 48 parts |
| 10% Aqueous solution of polyvinyl alcohol: | 35 parts |
| Ion-conductive polymer (ammonium polystyrene sulfonate) (CHEMITAT SA101, solid content: 33%): | 15 parts |
| Spherical electron-conductive filler (Ishihara Sangyo Kaisha, Ltd.; SN100P): | 1.5 parts |

Example 1

A sample of Example 1 was prepared in the same way as in Comparative Example 1 except that the back layer was formed using back layer coating solution C as shown below.

| Preparation of the back layer coating solution C | |
|---|---|
| Water: | 48 parts |
| 10% Aqueous solution of polyvinyl alcohol: | 35 parts |
| Ion-conductive polymer (ammonium polystyrene sulfonate) (CHEMITAT SA101, solid content: 33%): | 15 parts |
| Electron-conductive needle filler (needle Sb-doped $SnO_2$) (product of Ishihara Sangyo Kaisha Ltd., FS-10P) (short axis on average: 0.13 μm, long axis on average: 1.68 μm): | 1.5 parts |

Example 2

A sample of Example 2 was prepared in the same manner as in Comparative Example 1 except that the back layer was formed using back layer coating solution D as shown below.

| Preparation of the back layer coating solution D | |
|---|---|
| Water: | 48 parts |
| 10% Aqueous solution of polyvinyl alcohol: | 35 parts |
| Ion-conductive polymer (ammonium polystyrene sulfonate) (CHEMITAT SA101, solid content: 33%): | 15 parts |
| Electron-conductive needle filler (obtained by coating Sb-doped $SnO_2$ onto the surface of the needle $TiO_2$) (product of Ishihara Sangyo Kaisha Ltd., FT-2000) (short axis on average: 0.21 μm, long axis on average: 2.865 μm): | 1.5 parts |

Example 3

A sample of Example 3 was prepared in the same manner as in Comparative Example 1 except that the back layer was formed using back layer coating solution E as shown below.

| Preparation of the back layer coating solution E | |
|---|---|
| Water: | 48 parts |
| 10% Aqueous solution of polyvinyl alcohol: | 35 parts |
| Ion-conductive polymer (ammonium polystyrene sulfonate) (CHEMITAT SA101, solid content: 33%): | 15 parts |
| Electron-conductive needle filler (obtained by coating Sb-doped $SnO_2$ onto the surface of the needle $TiO_2$) (product of Ishihara Sangyo Kaisha Ltd., FT-3000) (short axis on average: 0.27 μm, long axis on average: 5.15 μm) | 1.5 parts |

Example 4

A sample of Example 4 was prepared in the same manner as in Comparative Example 1 except that the back layer was formed using the back layer coating solution F as shown below.

| Preparation of the back layer coating solution F | |
|---|---|
| Water: | 34 parts |
| 10% Aqueous solution of polyvinyl alcohol: | 55 parts |
| Ion-conductive polymer (ammonium polystyrene sulfonate) (CHEMITAT SA101, solid content: 33%) | 9 parts |
| Electron-conductive needle filler (obtained by coating Sb-doped $SnO_2$ onto the surface of the needle $TiO_2$) (product of Ishihara Sangyo Kaisha Ltd., FT-1000) (short axis on average: 0.13 μm, long axis on average: 1.68 μm): | 1.5 parts |

Example 5

A sample of Example 5 was prepared in the same manner as in Comparative example 1 except that the back layer was formed using back layer coating solution G as shown below.

| Preparation of the back layer coating solution G | |
|---|---|
| Water: | 34 parts |
| 10% Aqueous solution of polyvinyl alcohol: | 55 parts |
| Ion-conductive polymer (ammonium polystyrene sulfonate) (CHEMITAT SA101, solid content: 33%): | 9 parts |
| Electron-conductive needle filler (obtained by coating Sb-doped $SnO_2$ onto the surface of the needle $TiO_2$) (product of Ishihara Sangyo Kaisha Ltd., FT-1000) (short axis on average: 0.13 μm, long axis on average: 1.68 μm): | 1.5 parts |
| Spherical filler (PMMA, product of Soken Chemical & Engineering Co., Ltd., MX500, particle size: 5 μm): | 0.1 parts |

Example 6

A sample of Example 6 was prepared in the same manner as in Comparative example 1 except that the back layer was formed using back layer coating solution H as shown below.

| Preparation of the back layer coating solution H | |
|---|---|
| Water: | 34 parts |
| 10% Aqueous solution of polyvinyl alcohol: | 55 parts |
| Ion-conductive polymer (ammonium polystyrene sulfonate) (CHEMITAT SA101, solid content: 33%): | 9 parts |
| Electron-conductive needle filler (obtained by coating Sb-doped $SnO_2$ onto the surface of the needle $TiO_2$) (product of Ishihara Sangyo Kaisha Ltd, FT-1000) (short axis on average: 0.13 μm, long axis on average: 1.68 μm): | 1.5 parts |
| Spherical filler (PMMA, product of Soken Chemical & Engineering Co., Ltd., MX1,000, particle size: 10 μm): | 0.1 parts |

Example 7

A sample of Example 7 was prepared in the same manner as in Comparative example 1 except that the back layer was formed using back layer coating solution I as shown below.

| Preparation of the back layer coating solution I | |
|---|---|
| Water: | 70 parts |
| 10% Aqueous solution of core/shell resin (B1000, product of Mitsui Chemicals Inc.): | 18 parts |
| Ion-conductive polymer (ammonium polystyrene sulfonate) (CHEMITAT SA101, solid content: 33%): | 9 parts |
| Electron-conductive needle filler (obtained by coating Sb-doped $SnO_2$ onto the surface of the needle $TiO_2$) (product of Ishihara Sangyo Kaisha Ltd., FT-1000) (short axis on average: 0.13 μm, long axis on average: 1.68 μm): | 1.5 parts |
| Spherical filler 1 (PMMA, product of Soken Chemical & Engineering Co., Ltd., MX1000, particle size: 10 μm): | 0.1 parts |
| Spherical filler 2 (PMMA, product of Soken Chemical & Engineering Co., Ltd., MRG5G, particle size: 5 μm): | 0.4 parts |

Example 8

A sample of Example 8 was prepared in the same manner as in Comparative example 1 except that the back layer was formed by using back layer coating solution J as shown below.

| Preparation of the back layer coating solution J | |
|---|---|
| Water: | 34 parts |
| 10% Aqueous solution of core/shell resin (B1000, product of Mitsui Chemicals Inc.): | 18 parts |
| Ion-conductive polymer (ammonium polystyrene sulfonate) (CHEMITAT SA101, solid content: 33%): | 9 parts |
| Electron-conductive needle filler (obtained by coating Sb-doped $SnO_2$ onto the surface of the needle $TiO_2$) (product of Ishihara Sangyo Kaisha Ltd., FT-1000) (short axis on average: 0.13 μm, long axis on average: 1.68 μm): | 1.5 parts |
| Spherical filler 1 (PMMA, product of Soken Chemical & Engineering Co., Ltd., MX1000, particle size: 10 μm): | 0.1 parts |
| Spherical filler 2 (PMMA, product of Soken Chemical & Engineering Co., Ltd., MRG5G, particle size: 5 μm): | 0.4 parts |
| Inorganic filler P-527 (product of Mizusawa Industrial Chemicals, Ltd., silica, particle size: 0.2 μm): | 1.5 parts |

Example 9

A sample of Example 9 was prepared in the same manner as in Comparative Example 1 except that the back layer was formed using back layer coating solution K as shown below.

| Preparation of the back layer coating solution K | |
|---|---|
| Water: | 62 parts |
| Isobutylene polymer (product of Kuraray Co., Ltd., ISOBAN 304, weight average molecular weight: 60,000 to 70,000, solid content: 21%): | 18 parts |
| 10% Aqueous solution of polyvinyl alcohol: | 9 parts |
| Ion-conductive polymer (ammonium polystyrene sulfonate) (CHEMITAT SA101, solid content: 33%): | 9 parts |
| Electron-conductive needle filler (obtained by coating Sb-doped $SnO_2$ onto the surface of the needle $TiO_2$) (product of Ishihara Sangyo Kaisha Ltd., FT-1000) (short axis on average: 0.13 μm, long axis on average: 1.68 μm): | 1.5 parts |
| Spherical filler 1 (PMMA, product of Soken Chemical & Engineering Co., Ltd., MX1000, particle size: 10 μm): | 0.1 parts |
| Spherical filler 2 (PMMA, product of Soken Chemical & Engineering Co., Ltd., MRG5G, particle size: 5 μm): | 0.4 parts |
| Inorganic filler P-527 (product of Mizusawa Industrial Chemicals, Ltd., silica, particle size: 0.2 μm): | 1.5 parts |

Example 10

A sample of Example 10 was prepared in the same manner as in Comparative Example 1 except that the back layer was formed by coating back layer coating solution M as shown below and storing for 24 hours at 40° C. for effecting crosslinking.

| Preparation of back layer coating solution L | |
|---|---|
| Water: | 63 parts |
| Isobutylene polymer (product of Kuraray Co., Ltd., ISOBAN 304, weight average molecular weight: 60,000 to 70,000, solid content: 21%): | 18 parts |
| 10% Aqueous solution of polyvinyl alcohol: | 9 parts |
| Ion-conductive polymer (ammonium polystyrene sulfonate) (CHEMITAT SA101, solid content: 33%): | 9 parts |
| Electron-conductive needle filler (obtained by coating Sb-doped $SnO_2$ onto the surface of the needle $TiO_2$) (product of Ishihara Sangyo Kaisha Ltd, FT-1000) (short axis on average: 0.13 μm, long axis on average: 1.68 μm): | 1.5 parts |
| Spherical filler 1 (PMMA, product of Soken Chemical & Engineering Co., Ltd., MX1000, particle size: 10 μm): | 0.1 parts |

-continued

| Preparation of back layer coating solution L | |
|---|---|
| Spherical filler 2 (PMMA, product of Soken Chemical & Engineering Co., Ltd, MRG5G, particle size: 5 μm): | 0.4 parts |
| Inorganic filler P-527 (product of Mizusawa Industrial Chemicals, Ltd., silica, particle size: 0.2 μm): | 1.5 parts |
| Polyamide epichlorohydrin (paper strength agent WS-525: 25%): | 2 parts |

Example 11

A sample of Example 11 was prepared in the same manner as in Comparative Example 1 except that the back layer was formed by coating back layer coating solution M as shown below and storing for 24 hours at 40° C. for effecting crosslinking.

| Preparation of the back layer coating solution M | |
|---|---|
| Water: | 63 parts |
| Isobutylene polymer (product of Kuraray Co., Ltd., ISOBAN 304, weight average molecular weight: 60,000 to 70,000, solid content: 21%): | 18 parts |
| 10% Aqueous solution of polyvinyl alcohol: | 9 parts |
| Ion-conductive polymer (ammonium polystyrene sulfonate) (CHEMITAT SA101, solid content: 33%): | 9 parts |
| Electron-conductive needle filler (obtained by coating Sb-doped $SnO_2$ onto the surface of the needle $TiO_2$) (product of Ishihara Sangyo Kaisha Ltd., FT-1000) (short axis on average: 0.13 μm, long axis on average: 1.68 μm): | 1.5 parts |
| Spherical filler 1 (PMMA, product of Soken Chemical & Engineering Co., Ltd., MX1000, particle size: 10 μm): | 0.1 parts |
| Spherical filler 2 (PMMA, product of Soken Chemical & Engineering Co., Ltd., MRG5G, particle size: 5 μm): | 0.4 parts |
| Inorganic filler P-527 (product of Mizusawa Industrial Chemicals, Ltd., silica, particle size: 0.2 μm): | 1.5 parts |
| Aziridine compound (product of Nippon Shokubai, DZ-22E, solid content; 31%): | 2 parts |

Example 12

A sample of Example 12 was prepared in the same manner as in Comparative Example 1 except that the back layer was formed by coating back layer coating solution N as shown below and storing for 24 hours at 40° C. for effecting crosslinking.

| Preparation of back layer coating solution N | |
|---|---|
| Water: | 63 parts |
| Isobutylene polymer (product of Kuraray Co., Ltd., ISOBAN 304, weight average molecular weight: 60,000-70,000, solid content: 21%): | 18 parts |
| 10% Aqueous solution of polyvinyl alcohol: | 9 parts |
| Ion-conductive polymer (ammonium polystyrene sulfonate) (CHEMITAT SA101, solid content: 33%): | 9 parts |
| Electron-conductive needle filler (obtained by coating Sb-doped $SnO_2$ onto the surface of the needle $TiO_2$) (product of Ishihara Sangyo Kaisha Ltd., FT-1000) (short axis on average: 0.13 μm, long axis on average: 1.68 μm): | 1.5 parts |
| Spherical filler 1 (PMMA, product of Soken Chemical & Engineering Co., Ltd., MX1000, particle size: 10 μm): | 0.1 parts |
| Spherical filler 2 (PMMA, product of Soken Chemical & Engineering Co., Ltd., MRG5G, particle size: 5 μm): | 0.4 parts |
| Inorganic filler P-527 (product of Mizusawa Industrial Chemicals, Ltd, silica, particle size: 0.2 μm): | 1.5 parts |
| Aziridine compound (product of Nippon Shokubai, PZ-33): | 2 parts |

Example 13

A sample of Example 13 was prepared in the same manner as in Example 12 except that the white support was replaced with a white plastic support whose thermosensitive recording layer side has a surface glossiness of 14 [GS (75° C.)]% under JIS-P-8142 (FPG200, product of Yupo Corporation, PP film).

Example 14

Example 14 was prepared in the same manner as in Example 12 except that the particle size in dispersion solution A and B of the recording layer was adjusted to 1.5 μm.

Example 15

Example 15 was prepared in the same manner as in Example 12 except that the average particle size in the dispersion of filler in the protective layer was adjusted to 0.4 μm. Surface glossiness of the protective layer was 48 [GS (75° C.)]%.

(Evaluation Method)

With regard to the thermosensitive recording mediums prepared according to any of the Examples and Comparative Examples described above, the following items are evaluated:

1. Whiteness (Evaluation of Color Tone), Surface Glossiness
2. Amount of Charge
3. Sticking Property
4. Film Conveying Property
5. Water Resistance
6. Layer Adhesion
7. Curling
8. Homogeneity of Image
9. Glossiness of Image The results are shown in Table 1.

1. Whiteness

Color tone of the back layer of the thermosensitive recording medium was measured using SPECTROMETER produced by GretagMacbeth, to show b* value. As this value gets near to 0, the color tone of the object gets near to white.

2. Amount of Charge

Under the condition of 10° C. and 20% Rh, an image for evaluation was formed on the thermosensitive recording medium having A4 size by a thermal printer UP-D70XR produced by Sony corporation, followed by printing out 3 copies thereof. The amount of the charge at the time of releasing the films from the printer was measured using DESCO ELECTRIC FIELD METER MODEL NO. 19445.

3. Sticking Property

Two image sheets of A4 size were piled up and the degree of sticking of the two sheets was evaluated according to the following criteria:

A: No sticking was observed.
B: A trace of sticking was observed but the state of sticking was not maintained.
C: Slight sticking was observed but the state of the sticking was not maintained.
D: Slight sticking was observed and the state of the sticking was maintained for a while.
E: Tight sticking was observed.

4. Film Conveying Property

A hundred copies of the thermosensitive recording sheets having a gray image whose black ratio is 25% and a size of A4 were continuously printed out through automatic feeding by using a thermal printer UP-D70XR produced by Sony corporation. The number of failure in conveying was observed in which plural number of sheets were concurrently fed to the printer and conveyed as piled sheets.

AA: No failure in feeding was observed.
A: Failure in feeding 1 sheet was observed.
B: Failure in feeding 2-3 sheets was observed.
C: Failure in feeding 4-6 sheets was observed.
D: Failure in feeding 7-9 sheets was observed.
E: Failure in feeding 10 sheets or more was observed.

5. Water Resistance

One drop of water was put onto the surface of samples with a pipette, and 1 minute thereafter the water was wiped out with gauze. The mark that occurred after the wiping was evaluated through visual inspection.

AA: No mark was observed.
A: Slight mark was observed.
B: Small mark was observed.
C: Slight peeling off of the film was observed.
D: Complete peeling off of the film was observed.

6. Layer Adhesion

Scotch tape was adhered onto the surface of a sample, and it was peeled off at an angle of about 90°, and how it was peeled was evaluated through visual inspection.

A: No peeling was observed.
B: Peeling of small part of the film (layer) was observed.
C: Peeling of most part of the film (layer) was observed.
D: Peeling of the entire film (layer) was observed.

7. Curling

With a printer having dimensions of 210 mm×297 mm and having a thermal head of 12 dot/mm, all the background of the sample was printed at 0.147 W/dot and at impressed pulse width of 2 ms. The curling amount was measured using a metallic ruler, and the average of measured values of 4 sides of the sample was defined as a curling value (mm). The curling value was marked with "+" when the sample curled to the recording layer side, and "−" to the back layer side. The closer the curling value comes to 0, the better the curling performance of the sample becomes.

8. Homogeneity of the Image

Using a thermal printer UP-D70XR produced by Sony corporation, the thermosensitive recording medium of A4 size, on which an internal evaluation pattern was formed, was output, and homogeneity of the image was evaluated through visual inspection.

A: Halftone portion is printed homogeneously.
B: Slight white spots and irregularities were observed in the halftone portion.
C: Some white spots and irregularities were observed in the halftone portion.
D: Marked white spots and irregularities were observed in the halftone portion.

9. Glossiness of the Image

Using a thermal printer UP-D70XR produced by Sony corporation, an internal evaluation pattern on the thermosensitive recording medium was output as A4 size through automatic feeding. The glossiness of the solid portion of the image was measured by using gloss meter MODEL VG2000 75° produced by Nippon Denshoku Industries Co., Ltd. Increase of the measured value corresponds to increase of glossiness.

TABLE 1

| | Whiteness b* | Charge amount | Sticking property | Film conveying property | Water resistance | Layer adhesion | Curling value (mm) | Homogeneity of image | Glossiness of image |
|---|---|---|---|---|---|---|---|---|---|
| Comparative Example 1 | 1.2 | −0.5 kv | D | D | C | C | 50 | A | 92% |
| Comparative Example 2 | 0.9 | −1.2 kv | E | E | C | C | 50 | A | 92% |
| Example 1 | 0.5 | −0.7 kv | C | C | C | C | 50 | A | 92% |
| Example 2 | 0.2 | −0.5 kv | C | C | C | C | 50 | A | 92% |
| Example 3 | 0.2 | −0.5 kv | B | B | B | C | 48 | A | 92% |
| Example 4 | 0.2 | −0.5 kv | C | C | B | C | 51 | A | 92% |
| Example 5 | 0.2 | −0.5 kv | B | B | B | C | 45 | A | 92% |
| Example 6 | 0.2 | −0.5 kv | A | A | B | C | 36 | A | 92% |
| Example 7 | 0.2 | −0.5 kv | A | AA | B | C | 38 | A | 92% |
| Example 8 | 0.2 | −0.5 kv | A | AA | B | C | 12 | A | 92% |
| Example 9 | 0.2 | −0.5 kv | A | AA | B | C | 3 | A | 92% |
| Example 10 | 0.2 | −0.5 kv | A | AA | B | B | 3 | A | 92% |
| Example 11 | 0.2 | −0.5 kv | A | AA | A | B | 3 | A | 92% |
| Example 12 | 0.2 | −0.5 kv | A | AA | AA | A | 3 | A | 92% |
| Example 13 | 0.2 | −0.5 kv | A | AA | AA | A | 3 | C | 83% |
| Example 14 | 0.2 | −0.5 kv | A | AA | AA | A | 3 | A | 88% |
| Example 15 | 0.2 | −0.5 kv | A | AA | AA | A | 3 | A | 85% |

As shown in the above results, the present invention provides a thermosensitive recording medium excellent in whiteness and antistatic property, which includes a thermosensitive recording layer, on a white plastic support, containing, as main components, a binder resin as a binding agent, a colorless or pale color leuco dye and a color-developer to develop the leuco dye by heat; a protective layer disposed thereon; and a back layer disposed on the white plastic support at a side opposite to the side where thermosensitive recording layer is disposed, wherein the back layer contains at least an electron-conductive needle filler and an ion-conductive polymer.

What is claimed is:

1. A thermosensitive recording medium comprising:

a white plastic support, a thermosensitive recording layer comprising a binder resin as a binding agent, a colorless or pale color leuco dye and a color developer for heat-developing the leuco dye, a protective layer, and a back layer comprising an electron-conductive needle filler and an ion-conductive polymer, wherein the thermosensitive recording layer is disposed on the white plastic support, the protective layer is disposed on the thermosensitive recording layer, and the back layer is disposed on a side of the white plastic support opposite to the side where the thermosensitive recording layer is disposed.

2. The thermosensitive recording medium according to claim 1, wherein the electron-conductive needle filler is needle particles of titanium oxide each surface of which is coated with antimony-doped tin oxide.

3. The thermosensitive recording medium according to claim 1, wherein the electron-conductive needle filler has a long axis of an average length of 3 μm to 10 μm and a short axis of an average length of 0.1 μm to 0.5 μm.

4. The thermosensitive recording medium according to claim 1, wherein the hack layer comprises 10% by mass to 30% by mass of the electron-conductive needle filler and 10% by mass to 30% by mass of the ion-conductive polymer.

5. The thermosensitive recording medium according to claim 1, wherein the back layer further comprises a spherical filler.

6. The thermosensitive recording medium according to claim 5, wherein the spherical filler has an average particle size of 8 μm to 20 μm.

7. The thermosensitive recording medium according to claim 6, wherein the back layer further comprises a spherical filler having an average particle size of 1 μm to 6 μm in addition to the spherical filler having an average particle size of 8 μm to 20 μm.

8. The thermosensitive recording medium according to claim 1, wherein the back layer further comprises an inorganic filler having an average particle size of 0.5 μm or less.

9. The thermosensitive recording medium according to claim 1, wherein the back layer further comprises an isobutylene polymer having a weight average molecular weight of 30,000 or more.

10. The thermosensitive recording medium according to claim 1, wherein the back layer further comprises a resin component obtained by crosslinking an isobutylene polymer having a weight average molecular weight of 30,000 or more by a crosslinking agent.

11. The thermosensitive recording medium according to claim 10, wherein the crosslinking agent is an aziridine compound.

12. The thermosensitive recording medium according to claim 11, wherein the aziridine compound has three or more functional groups.

13. The thermosensitive recording medium according to claim 1, wherein the support is a white plastic film comprising a polypropylene resin and a white filler, and a glossiness of a surface of the support here the thermosensitive recording medium is disposed is 50 [GS (75°)]% or more in accordance with JIS-P-8142.

14. The thermosensitive recording medium according to claim 1, wherein each of the leuco dye and the color developer contained in the thermosensitive recording layer has a volume-average particle size of 0.3 μm to 1.0 μm.

15. The thermosensitive recording medium according to claim 1, wherein the protective layer has a surface glossiness of 50 [GS (75°)]% or more.

16. The thermosensitive recording medium according to claim 1, wherein the ion conductive polymer is a polymer having a function of an anionic surfactant, cationic surfactant, nonionic surfactant or amphoteric surfactant.

17. A recording method comprising heating and developing a thermosensitive recording medium using a printer equipped with a thermal head, wherein the thermosensitive recording medium comprises:

a white plastic support, a thermosensitive recording layer comprising a binder resin as a binding agent, a colorless or pale color leuco dye and a color developer for heat-developing the leuco dye, a protective layer, and a back layer comprising an electron-conductive needle filler and an ion-conductive polymer, wherein the thermosensitive recording layer is disposed on the white plastic support, the protective layer is disposed on the thermosensitive recording layer, and the back layer is disposed on a side of the white plastic support opposite to the side where the thermosensitive recording layer is disposed.

18. A recording method comprising developing a gradation image on a thermosensitive recording medium in accordance with a pulse control method, wherein the thermosensitive recording medium comprises:

a white plastic support, a thermosensitive recording layer comprising a binder resin as a binding agent, a colorless or pale color leuco dye and a color developer for heat-developing the leuco dye, a protective layer, and a back layer comprising an electron-conductive needle filler and an ion-conductive polymer, wherein the thermosensitive recording layer is disposed on the white plastic support, the protective layer is disposed on the thermosensitive recording layer, and the back layer is disposed on a side of the white plastic support opposite to the side where the thermosensitive recording layer is disposed.

* * * * *